United States Patent [19]

Reed

[11] 4,157,890

[45] Jun. 12, 1979

[54] NOx ABATEMENT IN GAS BURNING WHERE AIR IS PREMIXED WITH GASEOUS FUELS PRIOR TO BURNING

[75] Inventor: Robert D. Reed, Tulsa, Okla.

[73] Assignee: John Zink Company, Tulsa, Okla.

[21] Appl. No.: 836,380

[22] Filed: Sep. 26, 1977

[51] Int. Cl.[2] ..... F23C 7/00

[52] U.S. Cl. ..... 431/187; 431/349

[58] Field of Search ..... 431/187, 286, 349, 181, 431/202; 239/548, 556, 564, 601

[56] References Cited

U.S. PATENT DOCUMENTS

| | | | |
|---|---|---|---|
| 2,737,234 | 3/1956 | Reed | 431/349 |
| 2,901,033 | 8/1959 | Holden | 431/349 |
| 3,202,203 | 8/1965 | Reed | 431/349 X |

FOREIGN PATENT DOCUMENTS

| | | | |
|---|---|---|---|
| 1305269 | 8/1962 | France | 431/349 |
| 6515406 | 5/1967 | Netherlands | 431/349 |

*Primary Examiner*—Edward G. Favors

*Attorney, Agent, or Firm*—Head, Johnson & Chafin

[57] ABSTRACT

An improved gaseous fuel burner system for minimizing the production of NOx in a gas burner, comprising a primary burner, including a burner tube and a primary burner head, having a plurality of primary burner ports, in a two dimensional array, over a selected, substantially planar area, transverse to the burner tube. A mixture of gaseous fuel and primary air is supplied to the burner tube, and to the primary burner ports. Secondary combustion air is supplied around the burner tube and flows downstreamwardly to the primary burner and to the combustion zone downstream of the primary burner ports. Secondary burner ports are provided upstream of the primary burner ports, which carry the gaseous fuel and primary air in the form of jets, mixing with the secondary air, and burning to provide combustion products $CO_2$ and $H_2O$, which flow downstreamwardly with the secondary air into the combustion zone of the primary burner.

4 Claims, 12 Drawing Figures

NOX ABATEMENT IN GAS BURNING WHERE AIR IS PREMIXED WITH GASEOUS FUELS PRIOR TO BURNING

CROSS REFERENCE TO RELATED APPLICATION

This Application is realted to any co-pending application filed on the same date as this Application, Ser. No. 836,379; entitled "NOX ABATEMENT IN BURNING OF GASEOUS OR LIQUID FUELS".

BACKGROUND OF THE INVENTION

1. Field of the Invention

This invention lies in the field of gaseous fuel burners. More particularly, it concerns the design of a burner system which can burn gaseous fuels with a minimum quantity of NOx.

More particularly, it is concerned with a type of burner system in which the production of NOx is minimized.

2. Description of the Prior Art

Generation of oxides of nitrogen (NOx), which are air pollutants of a somewhat serious nature, is a characteristic of all fuels burning. It has been found impossible to completely stop all of the generation of NOx as fuels burn, but it is possible to suppress the production of NOx to a significant degree, in all cases, if the air for combustion is premixed with combustion gases $CO_2$ and $H_2O$ prior to combustion. Without the gas combustion products addition to the air supply, the NOx concentration may be hundreds of parts per million (PPM), but with added combustion product gases, the NOx evolved can be brought to less than 100 PPM.

The reduction of NOx is thought to be due to the presence of both, or either, $CO_2$ and $H_2O$ in the air, enroute to the combustion zone, to cause typical reactions as follows:

$$CH_4+CO_2=2CO+2H_2$$

and $$CH_4+H_2O=CO+3H_2$$

Through these reactions the combustible partial pressure within the reducing areas of the flame is approximately quadrupled, and NOx generally can supply oxygen for support of combustion, which reduces the NOx presence, as has been related. No better explanation has been advanced for NOx reduction in this manner. However, the problem involved is getting the $CO_2$ and $H_2O$, that is, the products of prior combustion, into the combustion air for introduction into the combustion zone of the principal fuel burning portion of the system.

Cumbersome means have been provided for the recirculation of flue gas from stack back to the burner, so that the products of combustion can be introduced into the combustion air prior to entry into the combustion zone. Such means for recirculation of stack gases is one expedient, but is a very expensive one, since it involves the necessity of conduits and blowers handling hot flue gases, etc. This invention provides the products of a preliminary combustion, upstream of the main gas burner so that the secondary air flowing to the primary burner will carry the products of combustion from the preliminary burner, into the main combustion zone. This provides for burning a small part of the gaseous fuel upstream of the main burner in such a way that the heat of combustion of the preliminary burner is combined with that of the main burner, and no heat is lost, while products of combustion from the preliminary burner are utilized in the main combustion zone to minimize NOx production.

SUMMARY OF THE INVENTION

It is a primary object of this invention to provide a family of gaseous fuel burners in which the production of NOx is minimized, by the use of a preliminary, or secondary, burner upstream of the primary burner, in which a small fraction of the total gaseous fuel is burned in the midst of the flow of secondary air, so that the products of complete combustion of a fraction of the gases are carried by the secondary air downstreamwardly into the combustion zone of the primary burner.

Several embodiments are shown of a generic system in which fuel gas and primary air pass into and through a burner tube, to a primary burner, having primary burner ports in a plane substantially perpendicular to the axis of the burner tube. Secondary combustion air is provided flowing outside of the burner tube, and into the combustion zone downstream of the primary burner ports.

A plurality of secondary burner ports upstream of the primary burner, provide jets of fuel gas and primary air into the zone of secondary air flow. These jets of gas are designed to carry in total only a small fraction of the total gas fuel flow, of the order of 10%, for example. The gas issuing from the secondary burner ports is completely burned in the excess air of the secondary air supply, to provide combustion products $CO_2$ and $H_2O$, which flow with the secondary air downstreamwardly into the combustion zone produced by the flow of fuel gas from the primary burner ports.

BRIEF DESCRIPTION OF THE DRAWINGS

These and other objects and advantages of this invention, and a better understanding of the principles and details of this invention, will be evident from the following description taken in conjunction with the appended drawings, in which.

DESCRIPTION OF THE PREFERRED EMBODIMENT

Figure 1:
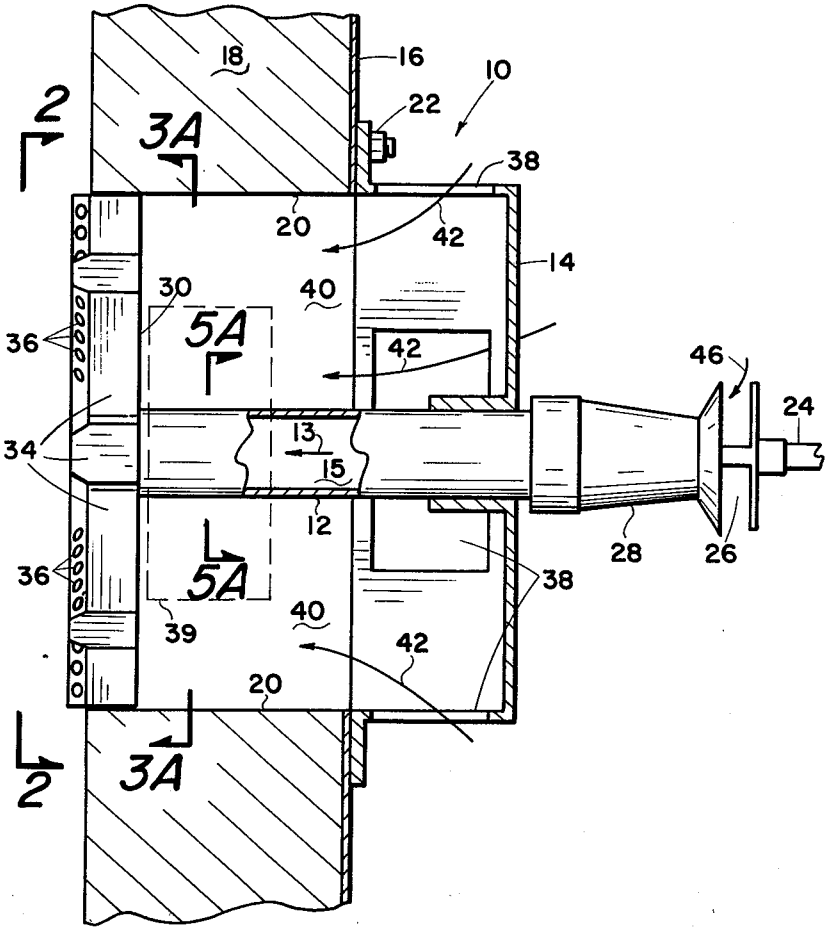
FIGS. 1 and 2 illustrate a transverse cross-sectional view and an end view of a generic form of this invention.
Figure 2:
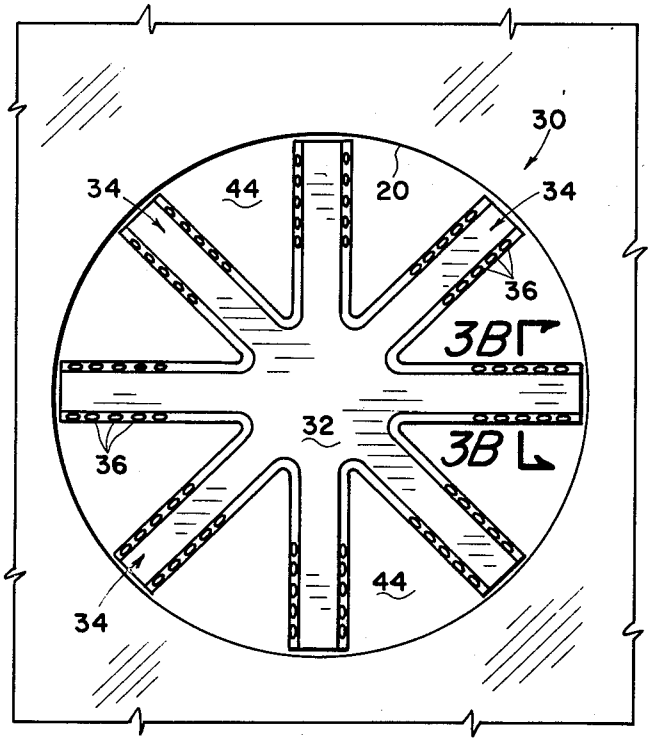

Referring now to the drawings and, in particular, to FIGS. 1 and 2, there is indicated by the numeral 10 the improved burner of this invention. It comprises a burner tube 12, which is supplied with gas through a supply pipe 24, the gas issuing along the axis of the burner 12 at the proximal end, with the induction of primary air 46 through the opening 26. The mixture of gas and primary air indicated by the arrow 13 flows down the interior of the burner tube to a primary burner comprising, generally, a plurality of primary burner ports in a two-dimensional array, over a selected substantially planar area, transverse to the axis of the burner tube. As will be shown in FIGS. 6 and 7, the primary burner ports can be in a transverse plane across, and closing off, the distal end of the burner tube, or it can be as in FIG. 2, in the form of a central plenum attached to the distal end of the burner tube, and including a plurality of radial pipes, generally of the nature of the prior art spider-type burners. The radial pipes are equally spaced circumferentially and are closed at their ends.

The burner is inserted into a circular opening 20 in the wall 18 of a furnace or other combustion device. The burner itself is supported by a metal support 14, which is attached to a plate 16, forming the outer surface of the wall 18. The attachment can be by any conventional means, such as the bolts 22. The support 14 generally provides a plurality of openings 38, through which secondary air can be drawn into the annular space 40 between the burner tube 12 and the wall 20 of the circular opening of the furnace wall.

There is a plurality of primary burner ports 36 drilled on the downstream side of the pipes 34, which provide jets in a direction downstream and transverse to the axis of the pipes 34. These jets flow into the triangular shaped passages 44 between the pipes 34 through which secondary air passes inside of the wall 20, and outside of the burner tube 12, into the combustion zone which forms immediately downstream of the secondary burner ports 36.

What has been described so far in FIGS. 1 and 2 is substantially the prior art burner of gaseous fuel. The innovation of this invention lies in the placement of a secondary burner in the cylindrical space shown by the dash line box 39, which is upstream of the primary burner and of the combustion zone of the gas issuing from the primary burner ports.

This invention pertains to gas burners, and there are two basic gas burning modes, that is, the burning of raw or unpremixed gas, and the burning of gas premixed with primary air. This invention pertains to burners which make use of the premixed gas, and primary air. The term "premix" refers to the premixture of primary air with gas, as the fuel gas is enroute to the primary burner, and the principal combustion zone. The air premixture with the gaseous fuel can provide varying percentages of stoichiometric air for burning the fuel. A vast majority of such burners provide premixture from 25% to 85% of stoichiometric air with the gas fuel, but there are some gas burners which cause premixture of 100% of stoichiometric air, or even a small amount of excess air. This invention is applicable to any type of premixed burner and in its essentials the invention provides two (not one) conditions of fuel burning, or two zones of burning, within the same burner structure. The primary burning condition is for the major portion of the fuel, and the secondary burner is for a selected small portion of the total fuel such as, for example, 10% of the total flow of gaeous fuel. The remaining 90% goes to the primary burner. The secondary burner, which is a preliminary burner, upstream of the primary burning zone, and within the secondary air flow toward the primary burning zone. The air flow into the burner is for the supply of air for both the primary and secondary burning, where less than stoichiometric air is premixed with the gas. Where stoichiometric air is entrained with the gaseous fuel the low pressure zone adjacent to the discharge of the secondary gas air mixture causes immediate indraft of the combustion products $CO_2$ and $H_2O$, from the prior secondary burning zone.

The secondary burner, which burns a small fraction of the total gaseous fuel, is placed upstream of the primary burner ports which are themselves upstream of the combustion zone in which the primary gas is burned. The secondary combustion zone must be upstream because the products of secondary combustion must flow with the combustion air, into the combustion zone of the primary burner. In the several embodiments shown, some of the embodiments show that the secondary burners are immediately upstream of the primary burner ports; others are farther upstream but the particular distance upstream is not critical and it can be any convenient spacing desired.

Figure 3B:
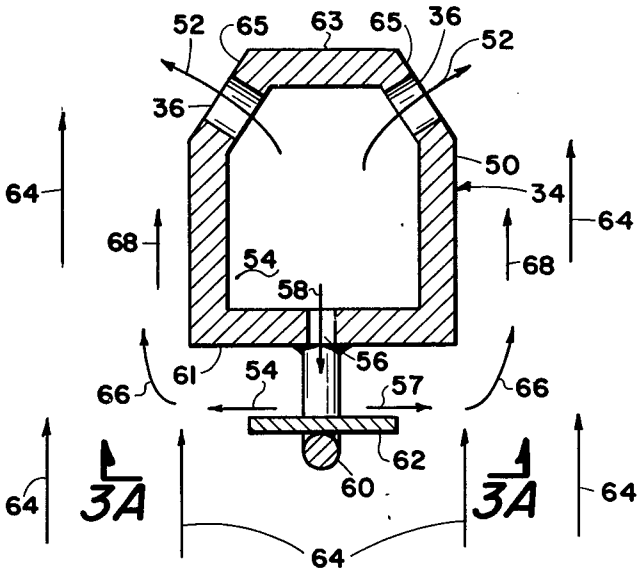
FIGS. 3A, 3B, and 3C indicate details of one embodiment of the generic embodiment of FIGS. 1 and 2.
Figure 3C:
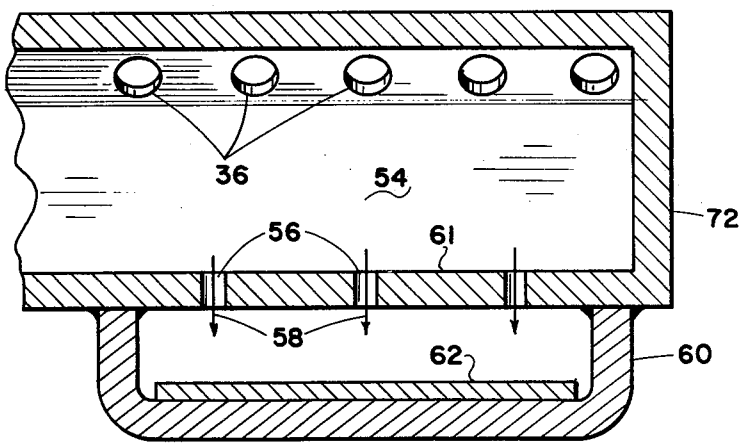
Figure 3A:
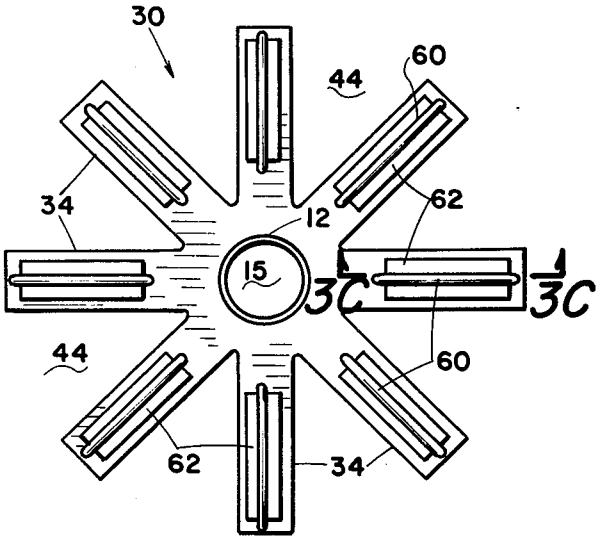

In FIGS. 3A, 3B, and 3C is shown one embodiment of the invention, in which the primary burners which are similar to FIGS. 1 and 2, in that the primary burner is of the spider type, having a plurality of radial arms or tubes. Such arms are shown in cross-section in FIG. 3B and comprise a pipe 50 having two sides and a base 61 upstream, with a downstream portion comprising a plate 63 with angular walls 65. The primary burner ports 36 are drilled in the sloping walls 65, and the gas and air mixture in the space 54 inside of the arms 50 flows outwardly through the primary burner ports 36 in accordance with the arrows 52, where they intersect the downstream flow of the secondary air 64 and form the combustion zone downstream of the plate 63 of the burner.

In the base 61 of the arms 50 are a plurality of ports 56 which direct gaseous fuel and primary air, in accordance with arrows 58, upstream against the flow of the secondary air 64. The jets of gas and primary air indicated by numeral 58 flow upstream-wise, against the direction of the secondary air 64, and mix with the air and burn.

It is preferable to provide a baffle plate 62 which may be supported by a rod 60 as indicated. This provides a sheltered zone in the lee of the plate 62, where the gas flow and air 58 can burn quietly without being extinguished by the large flow of air 64. In other words, the gas flow 58 can flow outwardly in accordance with the arrows 58 and burn and form products of combustion 66 which are principally $CO_2$ and $H_2O$. These combustion products flow in accordance with arrows 68 and arrows 64 into the combustion zone downstream of the burner arms 50.

FIG. 3C illustrates in a vertical plane through the arm the provision of the primary burner ports 36 and the secondary burner ports 56 through which the fuel and air flow upstream against the baffle 62 where they burn and provide combustion products to flow downstream with the secondary air. The relative diameters of the ports 36 and 56 are such that some small selected percentage of the fuel is burned in the secondary burner ports 56 while the major portion, possibly of the order of 90%, is burned in the primary burner ports 36.

Figure 4B:
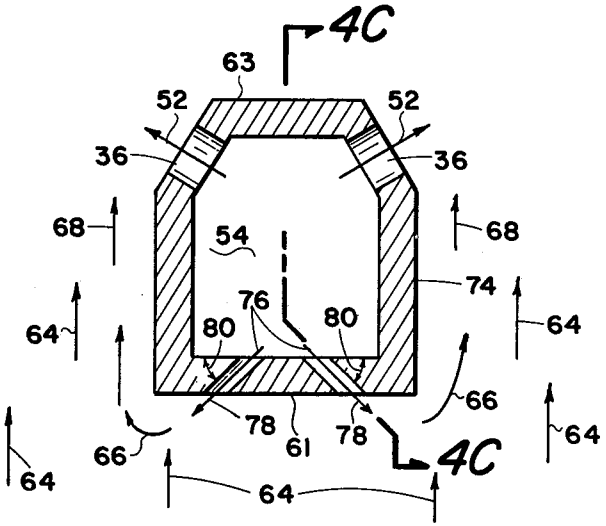
FIGS. 4A, 4B, and 4C illustrate a second embodiment of the generic embodiment of FIGS. 1 and 2.
Figure 4C:
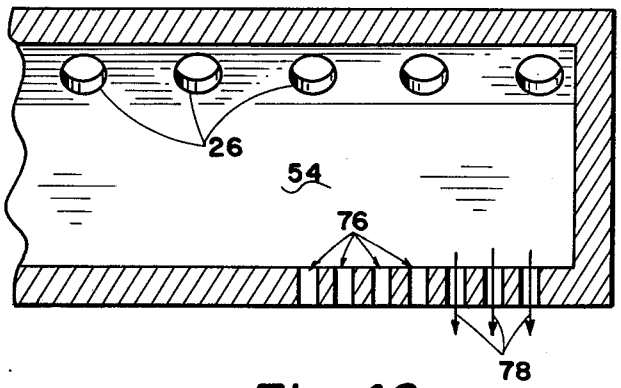
Figure 4A:
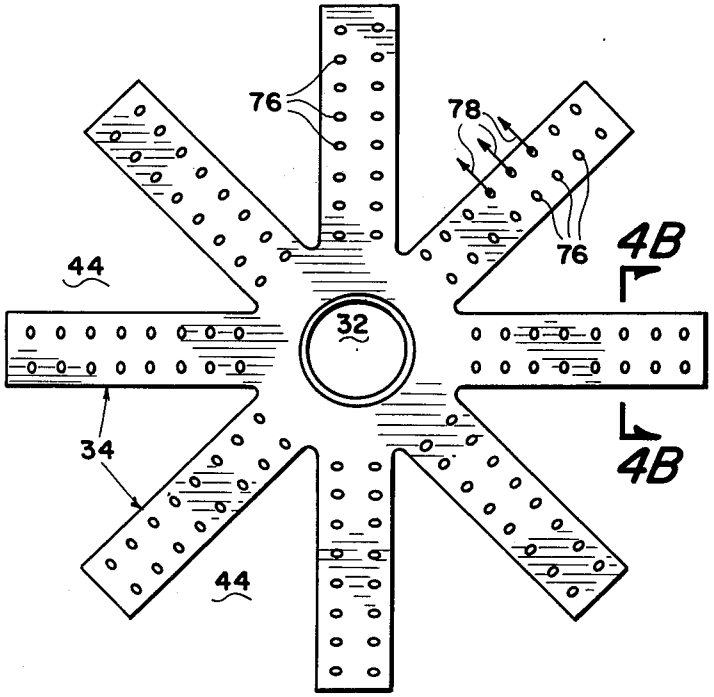

Referring now to FIGS. 4A, 4B, and 4C, there are three views of a second embodiment, generally similar to that of FIGS. 3A, 3B, and 3C. The secondary burner ports 76 are shown in the bottom wall 61 of the arms 74. These comprises the two rows of ports drilled outwardly at a selected angle 80 so that the gas flow 78 will intersect the downstreamwardly flowing air 64. The products of combustion indicated by the arrows 66 then flow downwardly with the air, in accordance with arrow 68 into the combustion zone of the primary burner ports 52, which is downstream of the burner arms.

In describing the two previous embodiments, that is, of FIGS. 3 and 4, the secondary burner ports were part of the primary burner structure—that is, they were in the upstream portions of the pipes or arms of the spider. While the radial pipes are shown in these figures as somewhat rectangular pipes, with sloping walls, they could just as well be circular pipes with the ports 36 drilled into the wall of the pipes at the corresponding angles shown in FIGS. 3B and 4B, respectively. Similarly, the secondary ports 56 could be directly upstream on a diametral plane of the circular pipe, or as shown in FIG. 4B the two rows of secondary burner ports could be drilled at any selected angle 80 as shown in FIG. 4B.

Figure 5B:
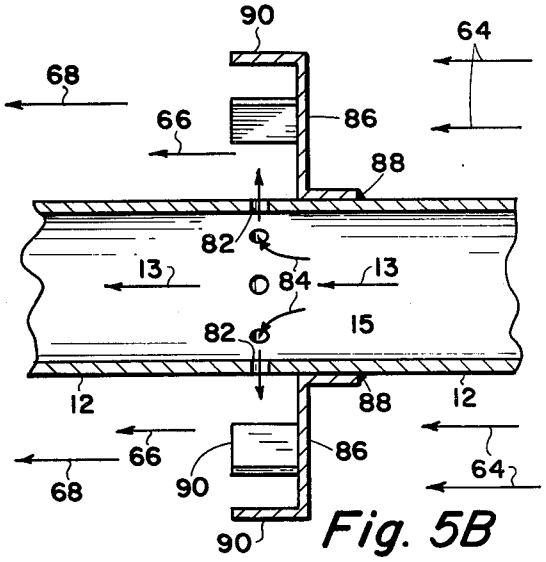
FIGS. 5A and 5B illustrate a third embodiment of the generic form of this invention.
Figure 5A:
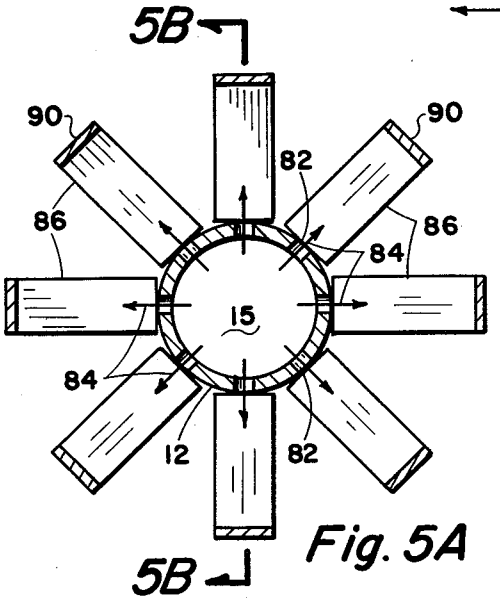

Referring now to FIGS. 5A and 5B, there is shown a third embodiment in which the secondary burner ports are provided farther upstream, than the upstream end of the spider. A spider is still provided, however, which will be, more or less, of the kind of spider shown in FIGS. 1 and 2.

Upstream of the spider 30 ports 82 are drilled in the wall of burner tube 12, in a transverse plane, and are equally spaced circumferentially. It is desirable, although not essential, that the number of ports 82 be equal to the number of arms of the spider, and that the ports be arranged in planes which bisect the triangular spaces 44 between the arms of the spider. The reason for this will be clear as the description proceeds.

A short distance upstream of the ports 82 are a plurality of Z-strips 86 which are supported by, and welded to, the burner pipe 12 at points 88, for example. The outer wings 90 of the Z-strips confine the flow of gas and primary air from the ports 82 in accordance with arrows 84, in the downstream area of the Z-strips 66. Here the air is quiet and the gas can burn with its primary air and secondary air taken from the air stream 64 flowing past the sides of the Z-strips. The products of combustion indicated by arrows 66 then move downstream with the secondary air 64 in accordance with arrows 68, and flow through the spaces 44 between the arms of the spider of FIG. 2 into the combustion zone downstream of the primary burner, which is the spider 30.

While baffles, such as 62 of FIG. 3B and 86 of FIG. 5B, are shown, which provide a sheltered area for the quiet combustion of the secondary burner ports, such as 56 and 82, it is possible to provide ports which inject the primary gas outwardly and preferably downstreamwardly, outside of the burner tube, where the gas is burned and the products of combustion are carried down to the primary combustion zone. However, the baffles will provide a preferred embodiment since there is greater assurance that the flame of the secondary combustion ports will not be blown out by the flow of secondary air.

In my co-pending application, Ser. No. 836,379, filed on the same date of this Application, I show another embodiment for a sheltered baffle, which is in the form of an annular plate having a downstreamwardly directed outer rim. The secondary combustion gas flows circularly in the lee of this baffle. Consequently, there are a number of baffle configurations which can be used to protect and permit a quiet burning zone for the secondary, small, combustion zone upstream of the major primary combustion zone.

Figure 6:
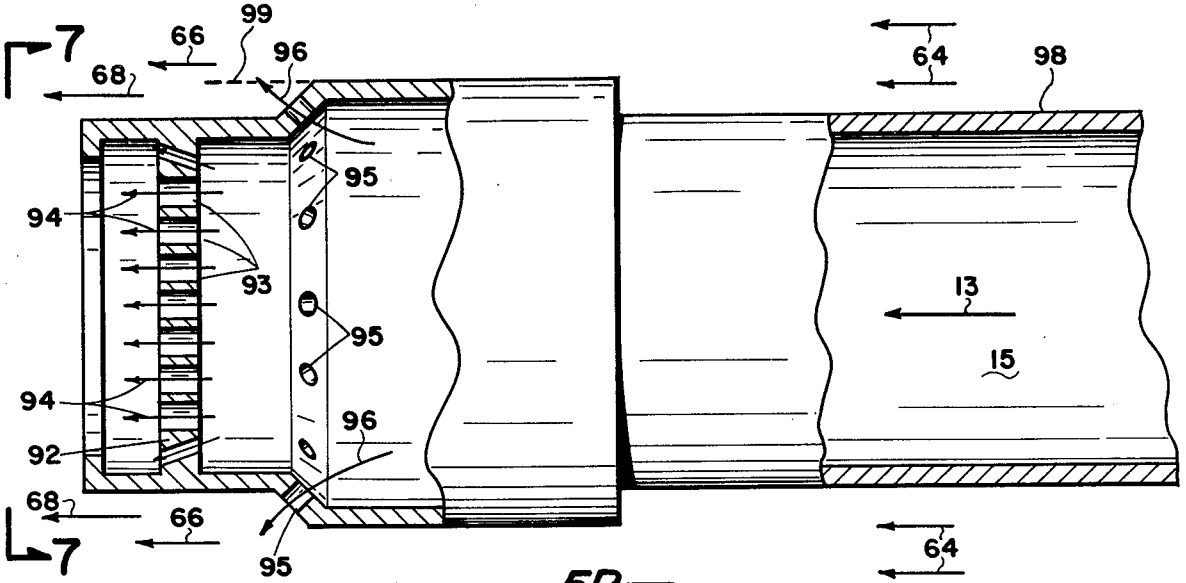
FIGS. 6 and 7 illustrate in transverse cross-section and end view a fourth embodiment of the generic form of this invention.
Figure 7:
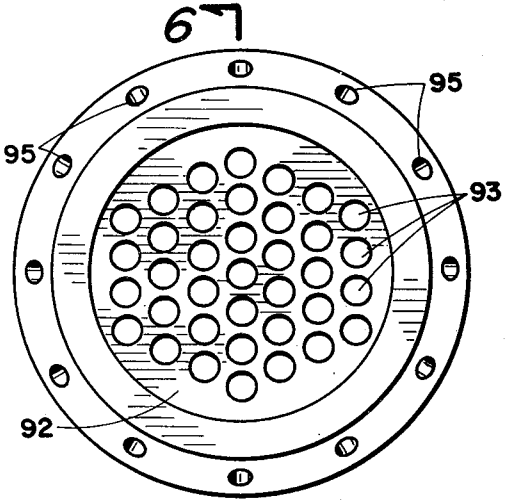

Referring now to FIGS. 6 and 7, there is shown another embodiment in which a circular plate 92 provides the burner, in the form of a plurality of burner ports 94, drilled parallel to the axis of the burner tube, and over the face of the plate. The total flow of gaseous fuel comes through the burner tube 98, which is of larger diameter than that shown in FIG. 1. In this case the major portion of the combustion air flows with the gas in accordance with arrows 13, through the space 15 inside the burner tube.

Upstream of the burner plate 92 is a plurality of ports 95, which are drilled in the wall of the burner tube, at an angle, outwardly and downstreamwardly, in accordance with arrows 96. Secondary air flows outside of the burner tube 98 and up past the secondary combustion zone, where the gas and air 96 issue from the ports 95, and are burned. The products of combustion, carbon dioxide and water, flow in accordance with arrows 66, with the air 64, to mix downstream in accordance with arrows 68 within the combustion zone of the burner ports 93. If desired, small baffle strips, shown by dashed line 99 in FIG. 6 could be welded to the outer surface of the burner head at each port 95.

What has been described is a burner system comprising two combustion zones, a primary combustion zone in which a major portion of the gaseous fuel is burned, for example, 90%, and a secondary combustion zone in which the remaining small percentage, such as 10%, is burned. The secondary combustion zone is positioned upstream of the primary combustion zone, and the products of complete combustion in the secondary combustion zone are carried downstream with the secondary air, and are mixed with the gaseous fuel and air issuing from the primary burner ports to enter the primary combustion zone, where the NOx generated in the primary combustion zone is reduced chemically, by the oxygen carriers, carbon dioxide and water, thus minimizing the total quantity of NOx generated in the burner system.

With these basic elements, the configuration of the burner system, of the primary and secondary burners, can be varied, with the primary burners in the form of a, more or less, conventional spider supplied with the gaseous fuel and primary air, or in the form of a burner plate covering a substantial area with parallel axially-directed ports. The secondary combustion ports are all upstream of the primary combustion zone and may be part of the spider arms in which the gas flows from the arms upstream, that is, counter to the flow of gas from the primary burner ports, and counter flow to the secondary air. In other embodiments of the secondary ports are in the wall of the burner tube and may flow outwardly, or outwardly and downstreamwardly, as desired. Also, baffles of various designs may be utilized to provide a quiet zone for the secondary combustion, so as to avoid blowing out of the flame.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed is:

1. In an improved gaseous fuel burner system for minimizing the production of NOx, comprising;

(a) a primary burner comprising a burner tube, and a primary burner head connected thereto, said burner head comprising a central plenum at the distal end of said burner tube, with a plurality of substantially radial pipes equally spaced around said plenum, said pipes closed at their ends, and having a plurality of primary burner ports directed outwardly and downstream thereof, a cylindrical opening in a wall, into which said burner is positioned;

(b) means to supply a mixture of said gaseous fuel and primary combustion air to and through said burner tube, to said burner head;

(c) means to supply secondary combustion air into said opening around said tube, moving downstreamwardly to said primary burner and through the open space remaining between said radial pipes, the improvement comprising;

(d) secondary burner ports in said radial pipes upstream of said primary burner ports, furnished with gaseous fuel and primary air from inside said burner tube, baffle plates positioned upstream and opposite of said secondary ports, whereby a portion of said gaseous fuel and primary air from inside said burner tube is directed through said secondary ports against said baffle and outwardly into the flow zone of said secondary air for burning upstream of said primary burner;

whereby the products of combustion of said secondary burner ports are carried by said flow of secondary air downstream into the combustion zone of said primary burner.

2. The burner system as in claim 1 in which the total gas flow through said secondary burner ports is a small fraction of the total gas flow through said primary ports.

3. The burner system as in claim 2 in which said small fraction is less than 0.1.

4. The burner as in claim 2 in which said small fraction is less than 0.25.

* * * * *